US006200161B1

(12) United States Patent
McClinton et al.

(10) Patent No.: US 6,200,161 B1
(45) Date of Patent: Mar. 13, 2001

(54) STACKED ELECTRICAL CONNECTOR

(75) Inventors: Jeffrey Byron McClinton, Harrisburg; Warren Christian Hillbish, Hummelstown, both of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/054,967

(22) Filed: Apr. 3, 1998

(51) Int. Cl.[7] ..... H01R 13/60
(52) U.S. Cl. ..... 439/541.5
(58) Field of Search ..... 439/541.5, 540, 439/639

(56) References Cited

U.S. PATENT DOCUMENTS

| | | | |
|---|---|---|---|
| Re. 35,039 | 9/1995 | Masuda et al. | 29/876 |
| D. 377,336 | 1/1997 | Tan et al. | D13/147 |
| 4,702,707 | 10/1987 | Hillbish | 439/80 |
| 4,818,239 | 4/1989 | Erk | 439/55 |
| 5,037,330 | 8/1991 | Fulponi et al. | 439/607 |
| 5,044,984 | 9/1991 | Mosser et al. | 439/540 |
| 5,080,609 | 1/1992 | Fabian et al. | 439/540 |
| 5,085,590 | 2/1992 | Galloway | 439/95 |
| 5,102,354 | 4/1992 | Crane et al. | 439/620 |
| 5,161,997 | 11/1992 | Defibaugh | 439/532 |
| 5,167,531 | 12/1992 | Broschard, III et al. | 439/540 |
| 5,267,876 | 12/1993 | Rupert et al. | 439/540 |
| 5,336,109 | 8/1994 | Hillbish et al. | 439/540 |
| 5,407,366 | 4/1995 | Briones et al. | 439/639 |
| 5,547,398 | 8/1996 | Ichikawa et al. | 439/607 |
| 5,643,008 | 7/1997 | Tan et al. | 439/541.5 |
| 5,695,362 | 12/1997 | Hillbish et al. | 439/541.5 |
| 5,755,592 | 5/1998 | Hillbish et al. | 439/541.5 |

OTHER PUBLICATIONS

*AMP Catalog 65445,* "Amplimite HD–20 Subminiature D Stacked PCB Connectors Series I, Series II and Hybrid Styles," 16 pages; Sep. 1992; AMP Incorporated, Harrisburg, PA.

*Foxconn Drawing No. 301–0100–465,* "Connector, Game/Audio Dual Port D–Sub . . . Audio Jack"; one page; (1995); Hon Hai Precision Ind. Co. Ltd., Taipei, Taiwan, Roc.

*Primary Examiner*—Renee Luebke
*Assistant Examiner*—Briggitte Hammond

(57) ABSTRACT

A stacked assembly (10) including an upper connector (14) and a lower subassembly having an insulative frame (12) and a plurality of lower connectors (16) disposed therein, for mounting on a circuit board. A rear insulative member (20) fastens to the frame, holds the lower connectors (16) in the frame and aligns legs (26) of contacts (28) of the upper connector. Ground plates (180) may be positioned in the frame forwardly of the lower connectors (116), with panel-engaging arms (190) projecting forwardly of the frame.

12 Claims, 7 Drawing Sheets

STACKED ELECTRICAL CONNECTOR

FIELD OF THE INVENTION

This relates to the field of electrical connectors and more particularly to assemblies of several connectors.

BACKGROUND OF THE INVENTION

In U.S. Pat. No. 5,695,362 is disclosed an assembly of a plurality of several connectors in a lower row of a frame member, and an additional connector in an upper row, with the mating faces of the connectors along a common face of the frame. Each of the connectors include pluralities of contacts secured in insulative housings. Contacts of all the connectors extend to and beyond a bottom face of the frame to be electrically connected to circuits of a circuit board onto which the assembly is mounted. A ground strap extends from an outer shield of the connector of the upper row to the frame bottom face, and a board lock at a lower end of the ground strap is insertable into a corresponding hole of the circuit board to establish a ground connection with a ground circuit of the board. A grounding clip is mounted in the frame in front of the several connectors of the lower row and is insertable into a corresponding hole of the circuit board to establish a ground connection with a ground circuit of the circuit board and the vertical conductive panel adjacent the mating face of the assembly, with the mating faces of the connectors exposed through cutouts of the panel. In particular, the connectors of the lower row are disclosed to be audio jacks.

In U.S. Pat. No. Des. 377,336 and in U.S. Pat. No. 5,643,008 is disclosed an assembly of a first connector mounted at the top of a bracket, and a second connector mounted along the bottom of the bracket, with the bracket mountable onto a circuit board. The second connector provides along a common mating face, a plurality of positions for mating with additional connectors. The mating faces of the connectors are located along a vertical face of the bracket orthogonal to the board mounting face of the bracket.

It is desired to provide a stacked assembly of a connector in an upper row and a plurality of mating sites in a lower row, without a separate frame member or bracket.

SUMMARY OF THE INVENTION

In the present invention, an upper connector is mounted to the top of an insulative frame, and a plurality of lower connectors are inserted into respective cavities of the insulative frame adjacent a board-mounting face of the frame. The mating face of the upper connector, and the mating faces of the lower connectors, are disposed along a common vertical face of the frame orthogonal to the board-mounting face. An insulative member is mountable to the frame rearwardly of the lower connectors and holds a pair of ground straps extending from the outer shield of the upper connector to the board-mounting face of the assembly, and engages lower ends of the elongate legs of contacts of the additional connector to maintain precise spacing and alignment thereof for board-connecting.

In one aspect of the invention, ground plates with panel-engaging arms and board-connecting legs are associated with each lower connector for shielding thereof at a panel cutout, and are disposed between each connector and a front wall of the insulative frame, being force fit between side walls of a respective connector-receiving recess of the frame.

Embodiments of the invention will now be disclosed by way of example with reference to the accompanying drawings.

DETAILED DESCRIPTION OF THE EMBODIMENTS

Figure 1:
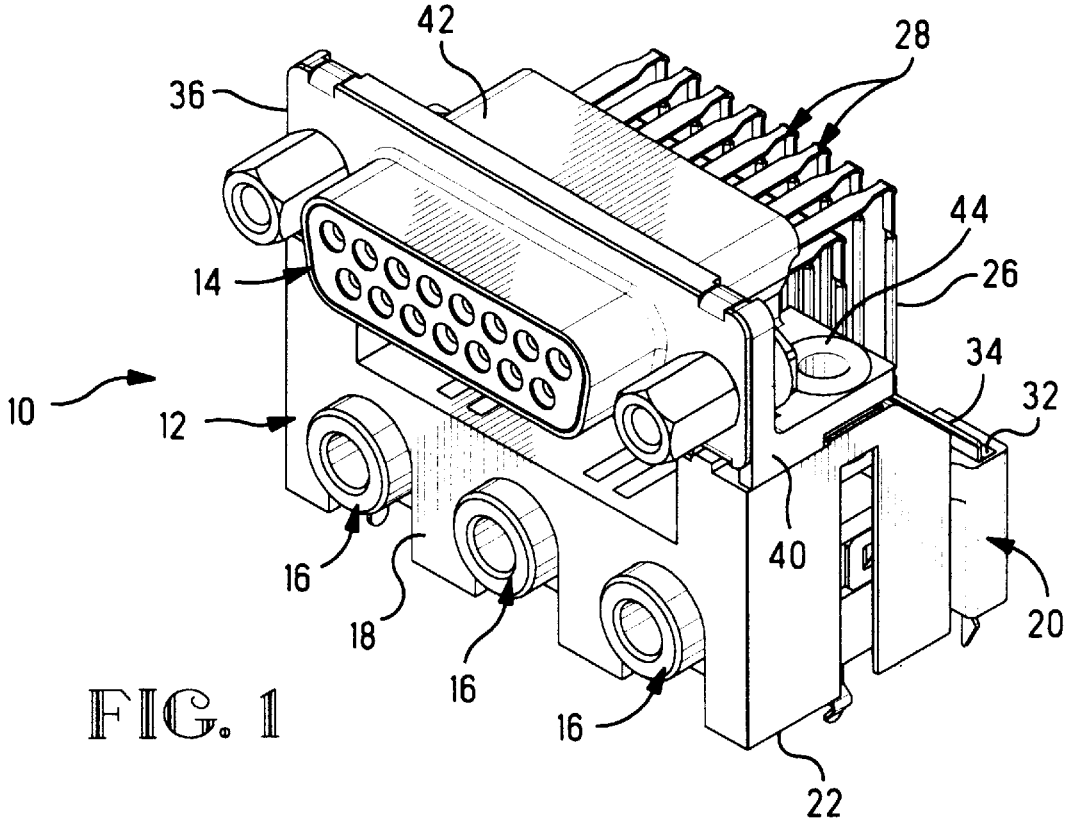
FIGS. 1 and 2 are front and rear isometric views of the stacked assembly.
Figure 2:
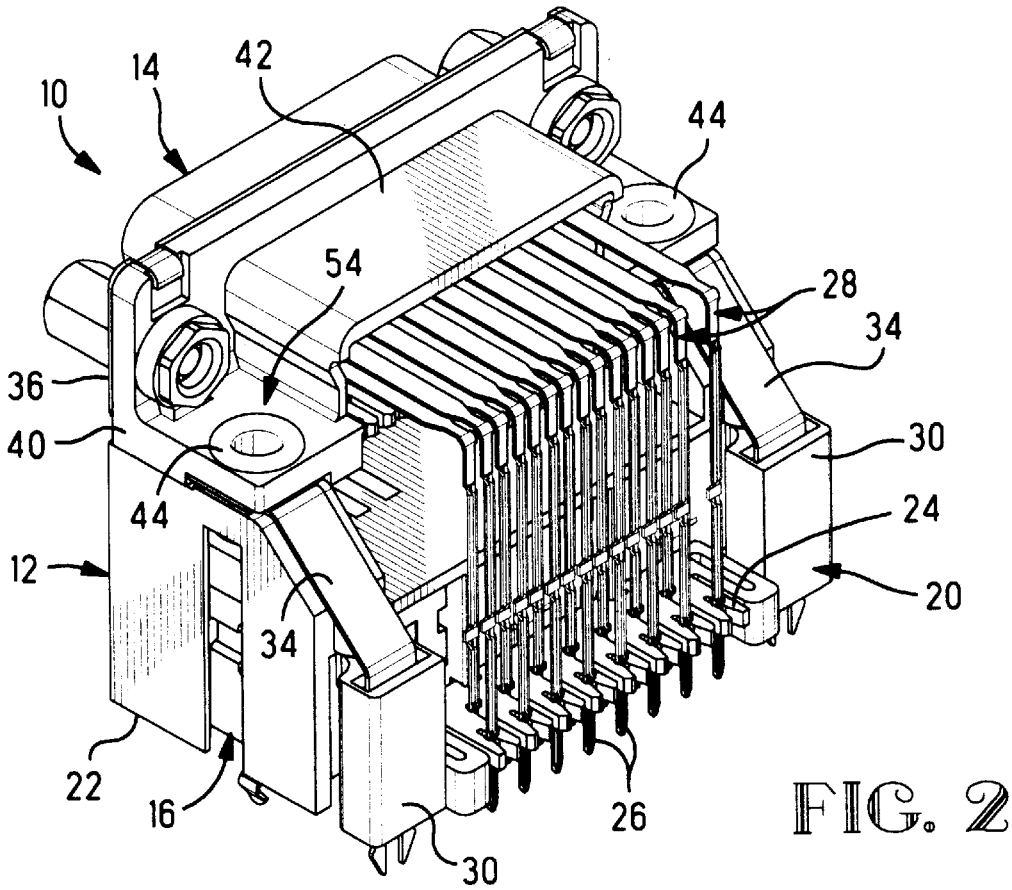
Figure 3:
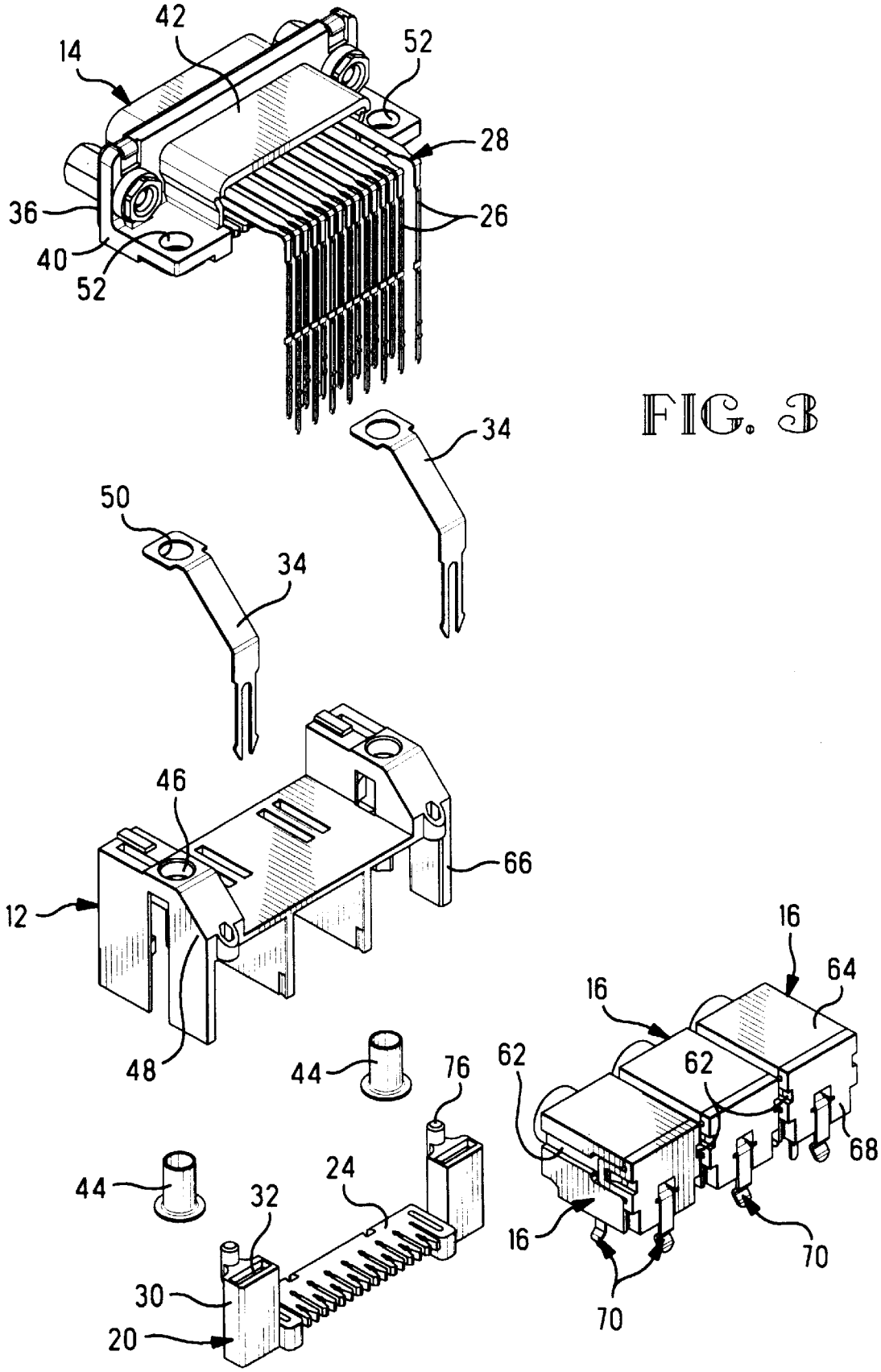
FIG. 3 is an exploded isometric view of the assembly of FIGS. 1 and 2.

Stacked assembly 10 of FIGS. 1 to 7 includes an insulative frame 12, an upper connector 14, and a plurality of lower connectors 16, the connectors having mating faces along a common front face 18 of the insulative frame. An insulative member 20 is secured along the rear face of insulative frame 12 adjacent the bottom or board-mounting face 22, and includes a spacer section 24 that secures lower portions of vertical legs 26 of contacts 28 of upper connector 14 to align them for insertion into through holes of a circuit board (not shown). Insulative member 20 also includes mounting sections 30 that secure in slots 32 thereof, ground straps 34 that extend from upper connector 14 to the board-mounting face 22. Insulative member 20 is similar to that disclosed in copending U.S. patent application Ser. No. 09/054,758 filed Apr. 3, 1998 (concurrently herewith) and assigned to the assignee hereof, wherein an integral housing defines a plurality of mating connector positions along the lower subassembly.

Figure 4:
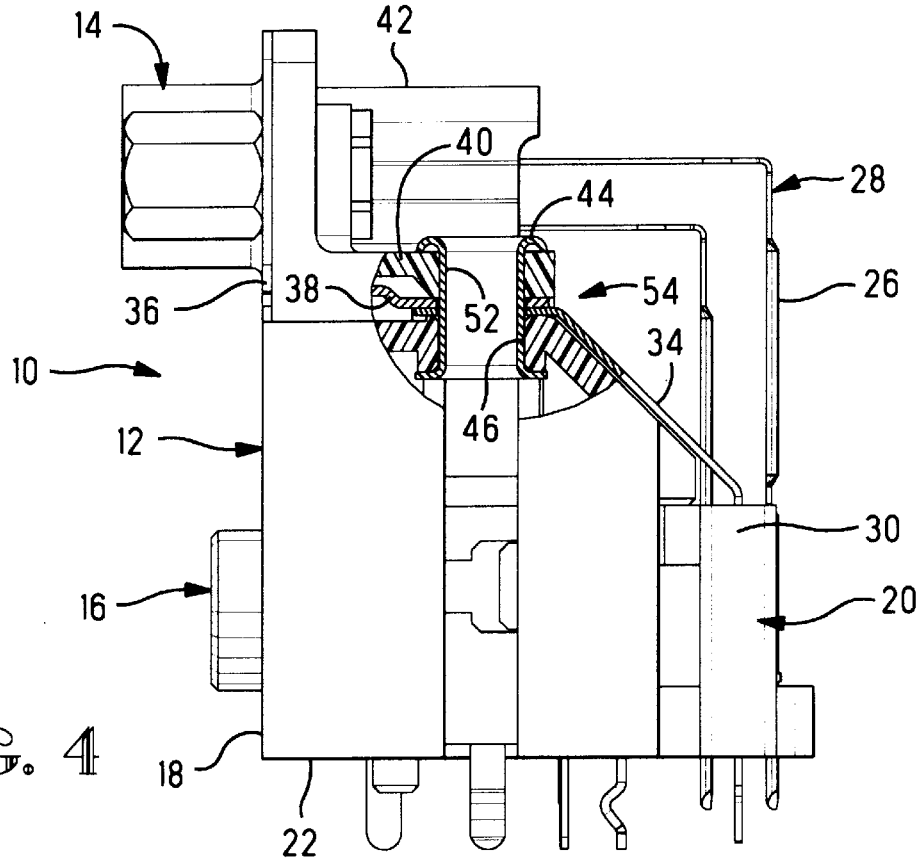
FIG. 4 is a part-sectioned elevation view of the stacked assembly of FIGS. 1 and 2.

Upper connector 14 includes a conductive shield 36 along its mating face that includes horizontal sections 38 extending rearwardly beneath mounting sections 40 of housing 42. Rivets 44 extend upwardly through holes 46 of mounting sections 48 of frame 12, through holes 50 of upper ends of straps 34, through holes of horizontal sections 38 of shield 36 and through apertures 52 of mounting sections 40 of housing 42, and are deformed as is conventional to secure upper connector 14 to frame 12 and also establish a ground connection 54 between shield 36 and ground straps 34, as shown in FIG. 4.

Figure 5:
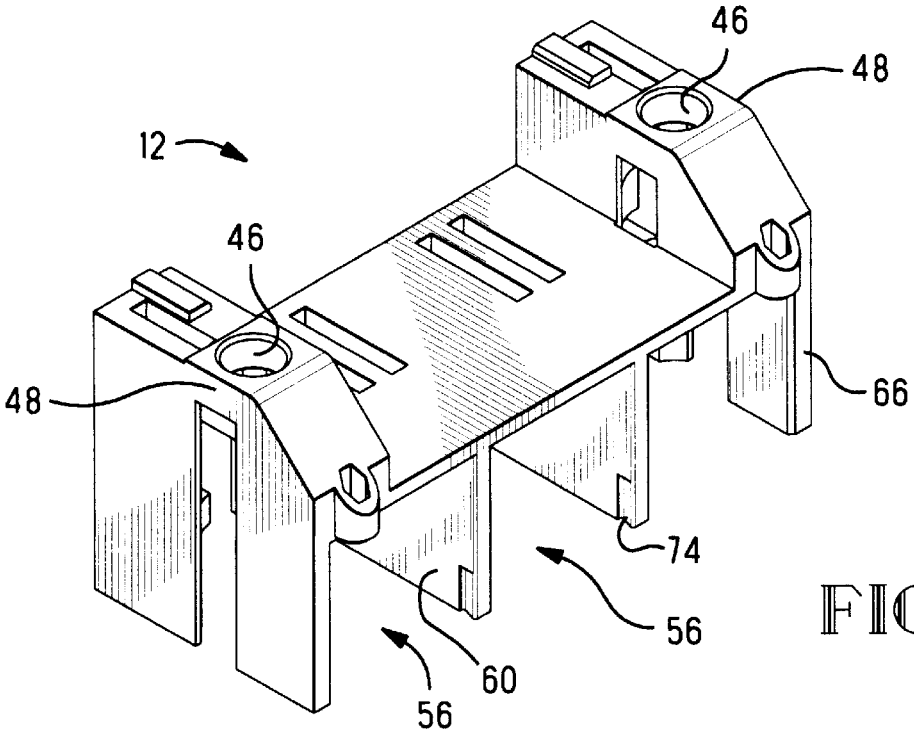
FIGS. 5 and 6 are upper and lower rear isometric views of the insulative frame of the assembly of FIGS. 1 to 4.
Figure 6:
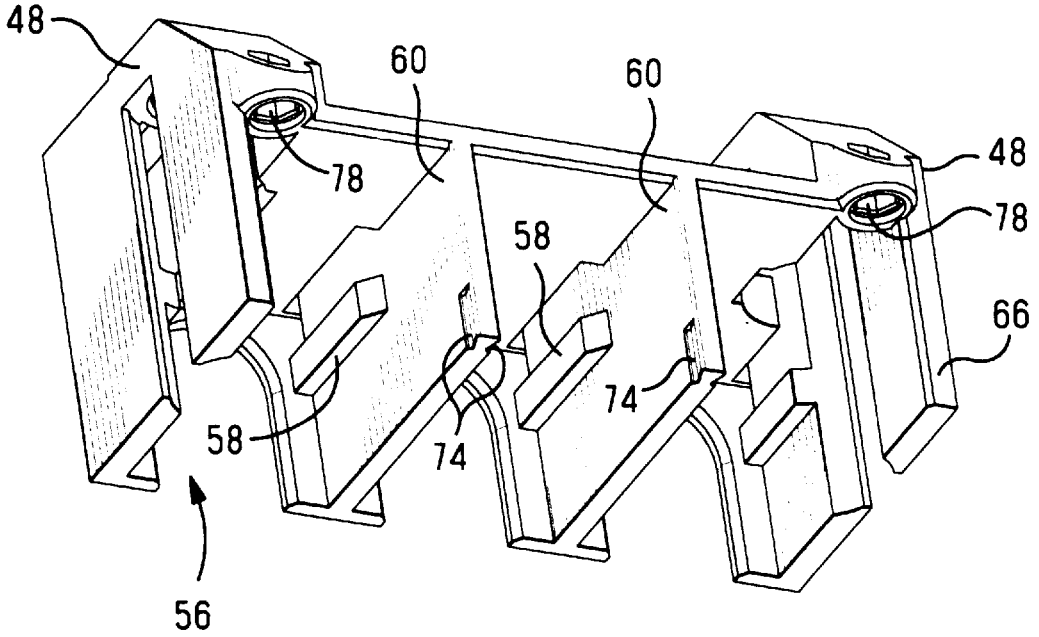
Figure 7:
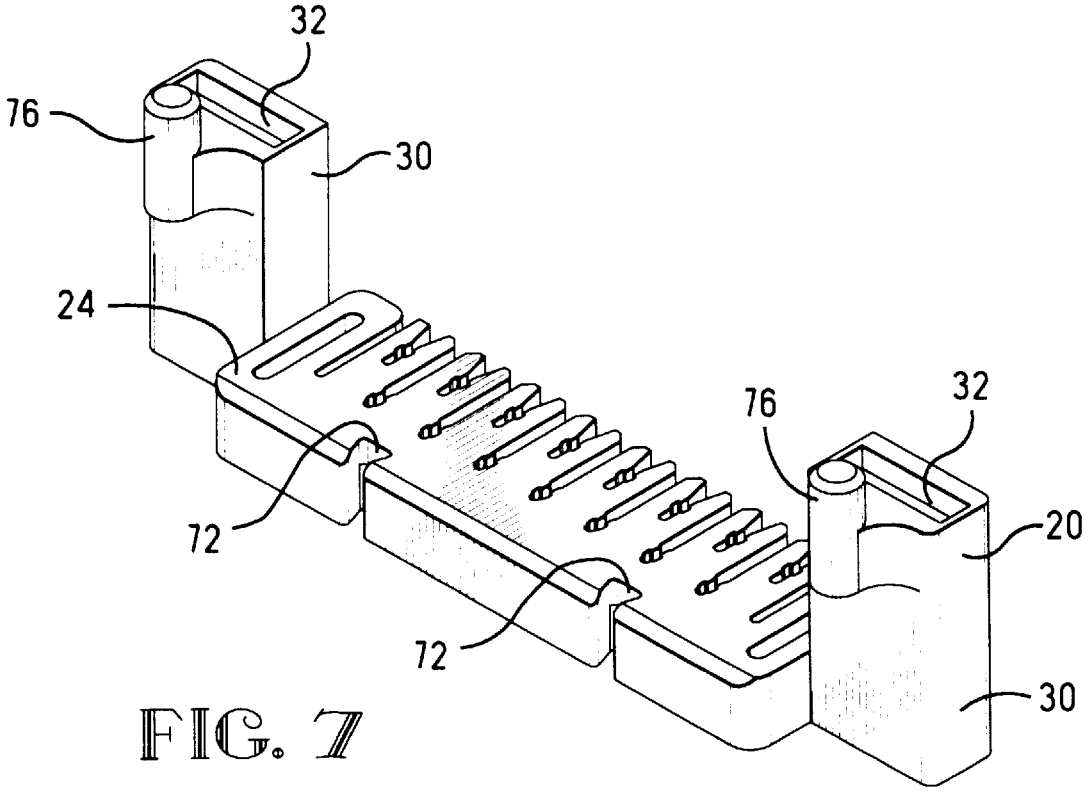
FIG. 7 is an isometric view of the insulative spacer of the assembly of FIGS. 1 to 4.
Figure 8:
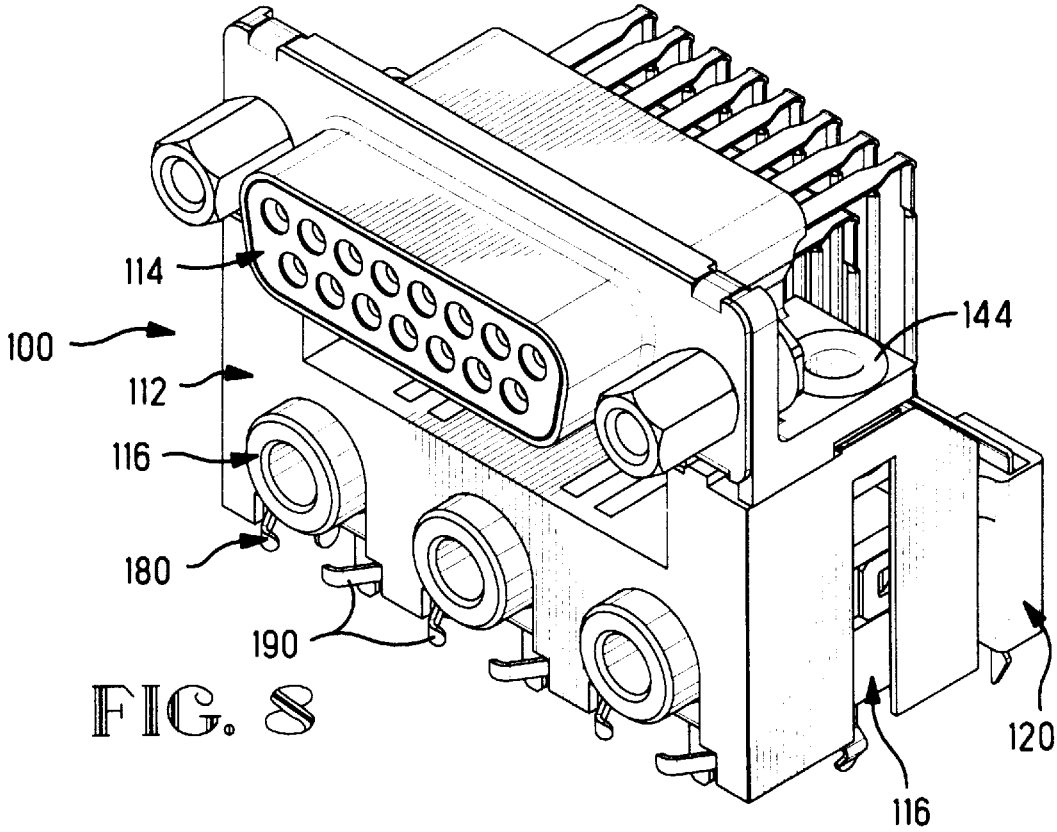
FIGS. 8 and 9 are upper and lower front isometric views a stacked assembly with ground plates for the lower connectors.
Figure 9:
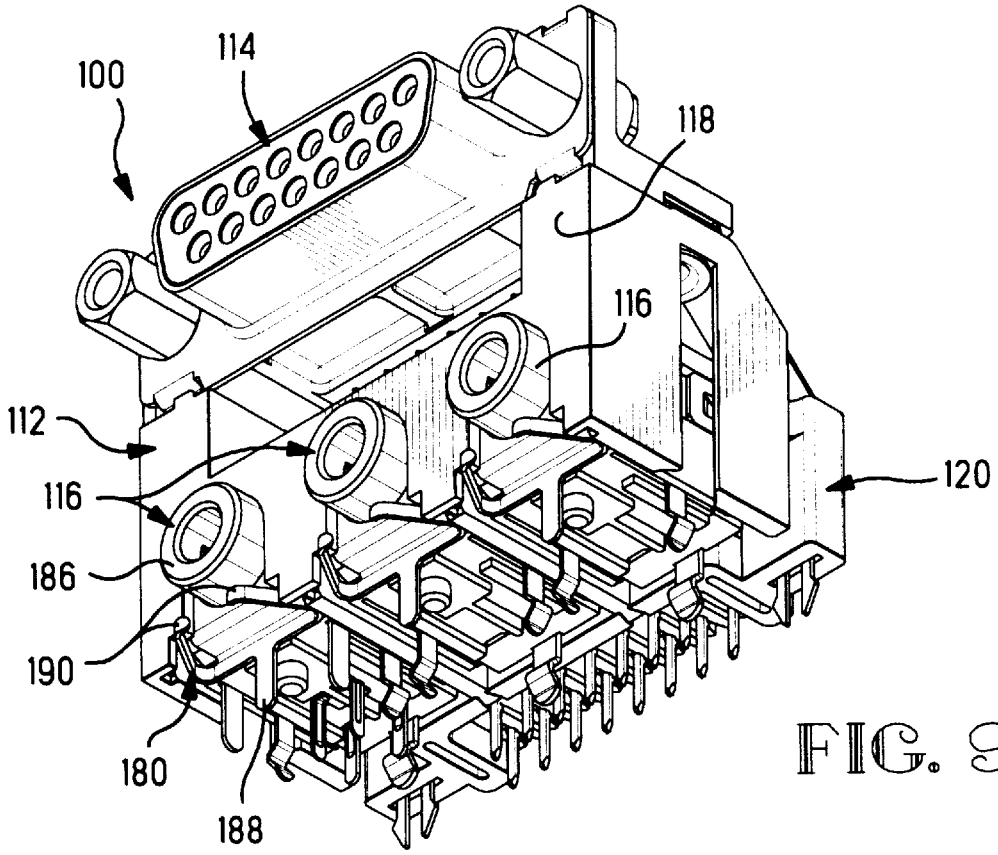
Figure 10:
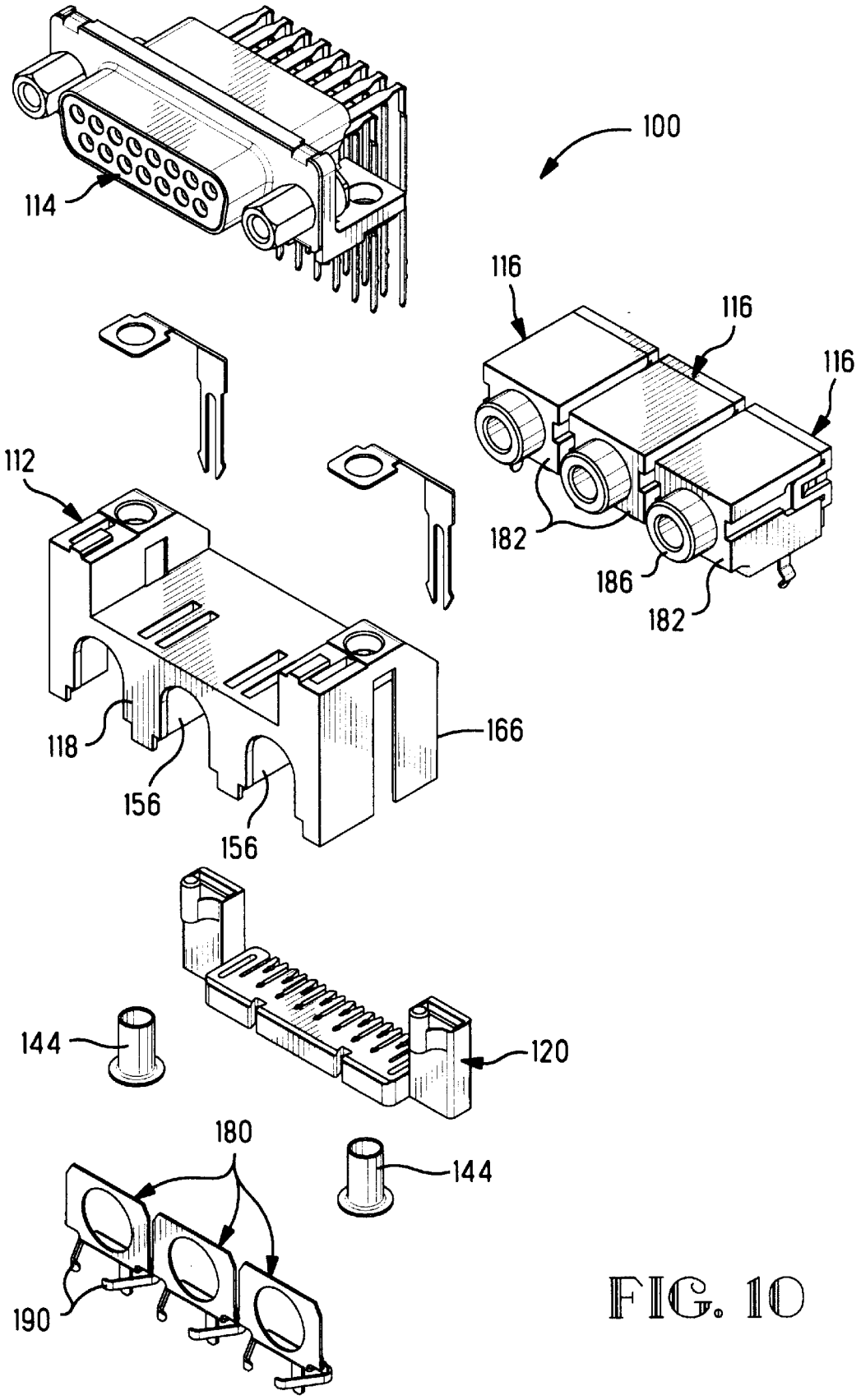
FIG. 10 is an exploded isometric view of the assembly of FIGS. 8 and 9.
Figure 11:
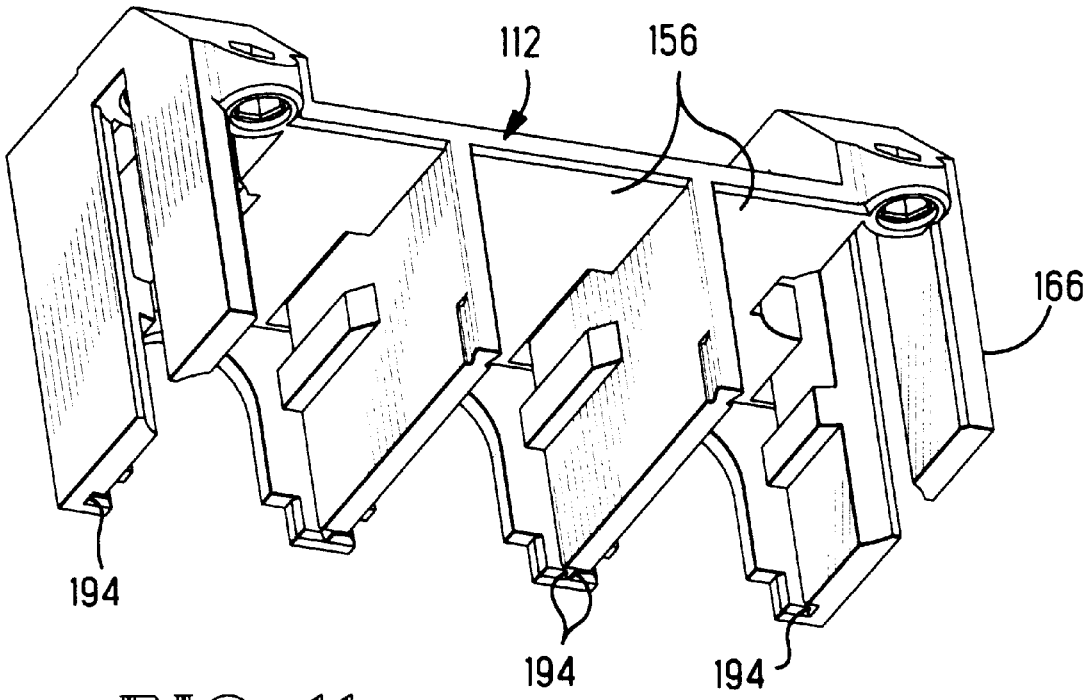
FIG. 11 is a lower rear isometric view of the insulative frame of the assembly of FIGS. 8 to 10.
Figure 12:
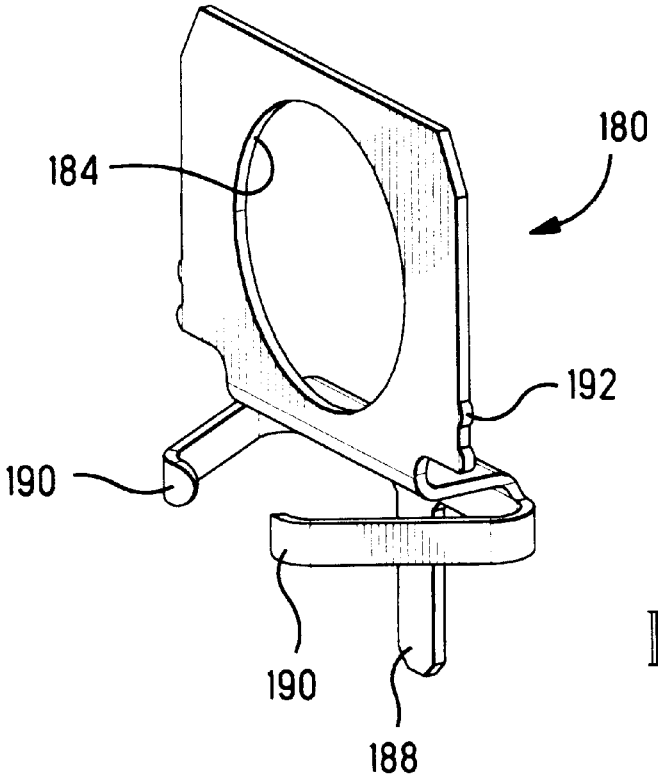
FIG. 12 is an isometric view of a ground plate of the assembly of FIGS. 8 to 11.

Insulative frame 12 is seen in FIGS. 5 and 6 to provide cavities 56 for respective ones of connectors 16. Horizontal guide rails 58 along side walls 60 of the cavities are received into corresponding channels 62 on sides of connector housings 64 of the connectors (FIG. 3), when connectors 16 are inserted from rear face 66. Connectors 16 are similar to the type sold by AMP Taiwan, Republic of China under Part Nos. 1-11130-3 and 1-11130-9, having an insulative rear cover 68; contacts 70 thereof include board-connecting legs depending beneath board-mounting faces thereof.

Insulative member 20 is affixed along rear face 66 of housing 12 rearwardly of connectors 16. Vertical undercut grooves 72 are slid onto complementarily-shaped guides 74 along the bottom rear of side walls 60 between cavities 56 for positioning, and by embossments 76 force fit into corresponding apertures 78 of mounting sections 48.

In assembly 100 of FIGS. 8 to 12, upper connector 114 is mounted to insulative frame 112 similarly to connector 14 mounted to frame 12 of FIGS. 1 to 7, by rivets 144. Lower connectors 116 are inserted into cavities 156 of frame 112, and insulative member 120 is secured to rear face 166 of frame 112 similarly to their counterpart components in FIGS. 1 to 7. A ground shield 180 is placed along the front face 182 of each lower connector 116, inside of the front wall of frame 112. Each shield 180 includes an aperture 184 to surround shroud 186 of the connector, a board-connecting leg 188 depending below the board-mounting face of the connector, and a pair of panel-engaging spring arms 190 that extend forwardly of front face 118 of housing 112 after assembly to engage a conductive panel (not shown) adjacent the cutouts for connectors 116. Each shield includes retention barbs 192 that establish a force fit with housing 112 when shield 180 is urged upwardly along the housing front wall within a cavity 156 in opposed slots 194. Thereafter, connectors 116 are assembled into housing 112 and the remainder of the assembly process may proceed.

In the present invention, conventional audio jack connectors, for example, are easily assembled in a stacked arrangement with another connector such as an AMPLIMITE D-subminiature connector of the type sold by AMP Incorporated, Harrisburg, Pa. An insulative member is securable to a frame to secure the connectors therein and provide for holding ground straps for grounding the shield of the upper connector and simultaneously align the elongate board-connecting legs of the upper connector contacts. Shielding of the audio jack connectors along a panel-adjacent face is economically provided. Variations and modifications to the present invention may be made that are within the spirit of the invention and the scope of the claims.

What is claimed is:

1. An electrical connector assembly having an upper connector positioned above a plurality of connector positions along a lower row in a stacked configuration, comprising:

said upper connector, and a lower subassembly beneath said upper connector defining said plurality of connector positions, all defining a stacked assembly;

said lower subassembly having an insulative frame providing cavities within which are disposed respective lower connectors therebeneath for connection to a circuit board, and said upper connector being affixed to said insulative frame; and an insulative member secured along a rear face of said insulative frame providing engagement with leg portions of contacts of said upper connector for spacing and alignment thereof for connection to circuits of said circuit board, said insulative member further including embossments projecting upwardly to be received into corresponding apertures of said insulative frame to secure said insulative member thereto, and said insulative member including vertical channels along a front face thereof that cooperate with complementarily shaped rear ends of side walls of said cavities of maid insulative frame to hold a bottom portion of said insulative member against a bottom portion of said insulative frame.

2. An assembly as set forth in claim 1, wherein said vertical channels and said rear ends cooperate via dovetail joints.

3. An assembly as set forth in claim 1 wherein ground plates are positioned forwardly of front faces of said lower connectors and along a rearwardly facing surface of a front wall of said insulative frame, and include panel-engaging arms projecting forwardly of said frame front wall.

4. An assembly as set forth in claim 3 wherein said ground plates are insertable along said rearwardly facing surface with side edges in vertical slots defined in said side walls on each side of each said cavity, and include apertures through which protrude shrouds of respective said lower connectors after assembly.

5. An assembly as set forth in claim 1 wherein said cavities of said insulative frame extend to said rear face and include guide rails along side walls that cooperate with channels along side walls of said lower connectors to facilitate insertion of said lower connectors into respective ones of said cavities.

6. An assembly as set forth in claim 5 wherein said insulative member stops rearward movement of said lower connectors to retain said connectors in said cavities.

7. A stacked electrical connector assembly having an upper connector positioned above a lower connector in a stacked configuration, comprising:

said lower connector mounted in a cavity of an insulative frame and said upper connector being affixed to said insulative frame; and an insulative member secured along a rear face of said frame providing engagement with leg portions of contacts of said upper connector for spacing and alignment thereof for connection to circuits of said circuit board, said insulative member further including embossments projecting upwardly to be received into corresponding apertures of said insulative frame to secure said insulative member thereto, and said insulative member including vertical channels along a front face thereof that cooperate with complementarily shaped rear ends of side walls of said cavity to hold a bottom portion of said insulative member against a bottom portion of said insulative frame.

8. An electrical connector assembly having an upper connector positioned above a plurality of connector positions along a lower row in a stacked configuration, comprising:

said upper connector, and a lower subassembly beneath said upper connector defining said plurality of connector positions, all defining a stacked assembly;

said lower subassembly having an insulative frame providing cavities within which are disposed respective lower connectors each including a shroud extending toward a front face of the insulative frame and electrical contacts depending therebeneath for connection to circuits of a circuit board, and said upper connector being affixed to said insulative frame; and a ground shield mounted within the insulative frame corresponding with each lower connector, wherein each ground shield has an aperture which receives the shroud of each lower connector, a board connecting leg, and at leapt one panel-engaging spring arm which extends forwardly of the front face of the insulative frame to electrically contact a panel surface.

9. An assembly as set forth in claim 8, wherein each ground shield includes retention barbs which retain the ground shield in the insulative frame in an interference fit.

10. An assembly as set forth in claim 8, wherein each ground shield has a pair of panel-engaging spring arms.

11. An assembly as set forth in claim 8, wherein an insulative member is secured along a rear face of said insulative frame providing engagement with leg portions of contacts of said upper connector for spacing and alignment thereof for connection to circuits of said circuit board.

12. An assembly as bet forth in claim 11, wherein ground straps extend through portions of the insulative member to a ground connection with a shield of said upper connector and to ground circuitry on the circuit board.

* * * * *